United States Patent [19]

Balogh et al.

[11] Patent Number: 4,576,585

[45] Date of Patent: Mar. 18, 1986

[54] TOY FIGURES WITH VACUUM CHANGEABLE FEATURES

[75] Inventors: John M. Balogh; Rouben T. Terzian, both of Chicago, Ill.

[73] Assignee: Marvin Glass & Associates, Chicago, Ill.

[21] Appl. No.: 694,616

[22] Filed: Jan. 24, 1985

[51] Int. Cl.[4] ..... A63H 13/00; A63H 3/20

[52] U.S. Cl. ..... 446/199; 446/198; 446/320; 446/321; 446/340

[58] Field of Search ..... 446/199, 198, 197, 183, 446/185, 190, 180, 176, 200, 226, 340, 339, 337, 338, 320, 321, 296, 385, 27

[56] References Cited

U.S. PATENT DOCUMENTS

| | | | |
|---|---|---|---|
| 737,337 | 8/1903 | Cairns | 446/198 |
| 1,480,780 | 1/1924 | Pauley | 446/27 X |
| 2,203,562 | 6/1940 | Edwards | 446/27 X |
| 3,822,500 | 7/1974 | Ostrander | 446/183 |
| 4,087,933 | 5/1978 | Strongin | 446/183 |
| 4,240,224 | 12/1980 | Katzman et al. | 446/197 |
| 4,259,805 | 4/1981 | Hornsby, Jr. | 446/198 |
| 4,518,367 | 5/1985 | Zaruba et al. | 446/339 X |

FOREIGN PATENT DOCUMENTS

| | | | |
|---|---|---|---|
| 730495 | 5/1955 | United Kingdom | 446/197 |

*Primary Examiner*—Mickey Yu

*Attorney, Agent, or Firm*—John S. Pacocha

[57] ABSTRACT

A toy figure with a head having a substantially rigid outer surface of a first appearance is covered by a relatively flexible outer mask having a second appearance which is self-supporting in normal atmospheric pressure. The mask is secured in substantially airtight relationship covering, but spaced from, the outer surface of the head. Reduction of the pressure in the space between the outer surface of the head and the mask by a pump collapses the mask and conforms its appearance to the first appearance of the outer surface of the underlying head. Both the interior of the mask and the outer surface of the head are provided with approximately the same surface area. Upper and lower portions of the torso of the figure are slidingly separable to operate a piston pump to reduce the pressure in the space between the head and the mask.

16 Claims, 5 Drawing Figures

TOY FIGURES WITH VACUUM CHANGEABLE FEATURES

BACKGROUND OF THE INVENTION

1. Field Of The Invention

This invention relates generally to toy characters or figures and more particularly to a toy character that has a portion changeable from one appearance to another in response to a change in air pressure.

2. Background Art

Action characters or figures, particularly those which may be manipulated or actuated to perform some act or effect some change in the character, are popular toys. An example of such toy figures currently enjoying commercial success are the Battle Armor, He-Man and Skeletor figures sold by Mattel, Inc. in which a cylindrical piece revolves to show dents in chest armor. U.S. Pat. No. 3,346,989 discloses a prior art toy pneumatic space capsule for a character in which a pump was used to change the shape or position of bellows arms molded with preset accordion pleats to bring the ends of the arms in toward each other. In prior art U.S. Pat. Nos. 3,153,881 and 2,688,208, changes in pressure have been used to animate portions of a doll. However, the mechanisms employed in the dolls disclosed in the prior art U.S. Pat. Nos. 3,153,881 and 2,668,208 were relatively complex and would have to be used in rather large scale dolls. Accordingly, there remains a need for a simplified mechanism that will enable the use of a pressure operated changeable feature in smaller scale action characters or figures in the range of three to seven inches tall.

SUMMARY OF THE INVENTION

The present invention is concerned with providing a toy that includes an appearance changing portion responsive to changes in air pressure having an underlying part with a substantially rigid outer surface of a first appearance covered by a relatively flexible outer mask which is self-supporting in normal atmospheric pressure with a second appearance and which is secured in substantially airtight relationship over the underlying part but otherwise spaced from the rigid outer surface. A pump withdraws air from the space between the outer surface of the rigid part and the inner surface of the flexible part to collapse the flexible mask and conform its appearance to that of the relatively rigid outer surface of the underlying part. Both the interior of the flexible outer mask and the outer surface of the relatively rigid underlying part are provided with approximately the same surface area.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
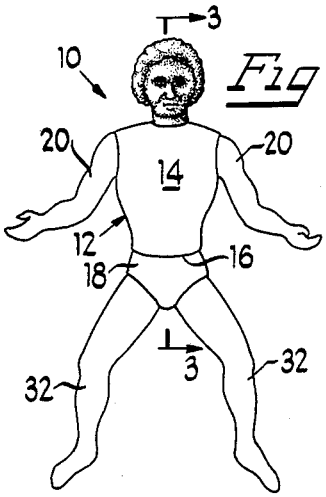
FIG. 1 is a front elevational view of a toy character embodying the invention showing one appearance.
Figure 4:
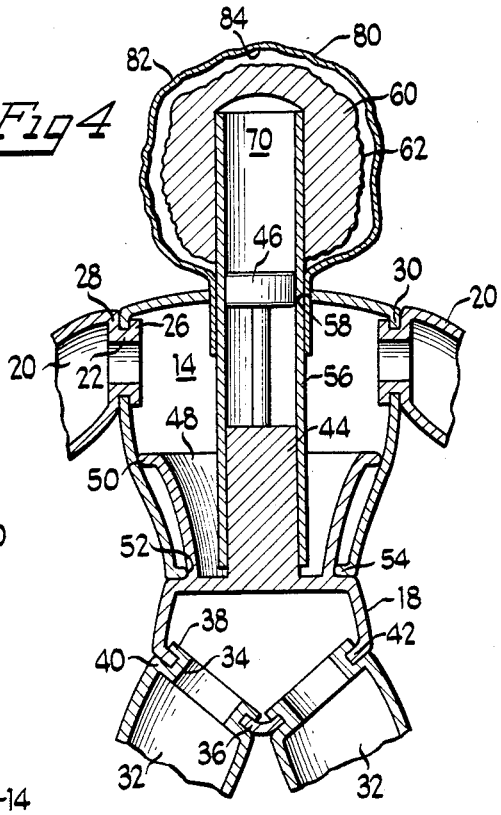
FIG. 4 is a fragmentary, sectional view taken generally along line 4—4 of FIG. 3.

Referring now to the drawing in which like parts are designated by like reference numerals throughout the several views, there is shown in FIG. 1 a toy character 10 having a torso 12 with an upper chest portion 14 and, separated by waist 16, a lower hip portion 18. Attached, for rotational movement relative to the upper chest portion 14 are arms 20. As shown in FIG. 4, the upper end of each of the arms 20 is formed with a relatively thick wall 22 having an outer annular circular groove 24 of substantially rectangular cross section forming a shoulder 26 on the inner side and a generally parallel annular flange 28 on the outer side. Upper chest portion 14 in the area of the shoulders includes an inwardly directed radial flange 30 that fits into the groove 24 to retain the arm 20 while permitting rotational movement of the arm relative to the chest.

Hip portion 18 has legs 32 attached for rotational movement relative to the hip portion in a manner similar to the attachment of the arms 20. At the upper end of each leg there is a relatively thick wall 34 with an outer annular circular groove 36 of generally rectangular cross section forming a shoulder 38 on one side and a parallel outer, annular flange 40 at the other end. The hip portion 18 has a pair of openings with radially inwardly directed hip flanges 42 each of which fits into an annular groove 36 in one of the legs 32 to retain the leg within the hip portion while permitting rotational motion of the leg relative to the hip portion. Other conventional methods of attaching articulated limbs, such as ball joints, could be used or, as another alternative, nonarticulated limbs could be used.

Figure 5:
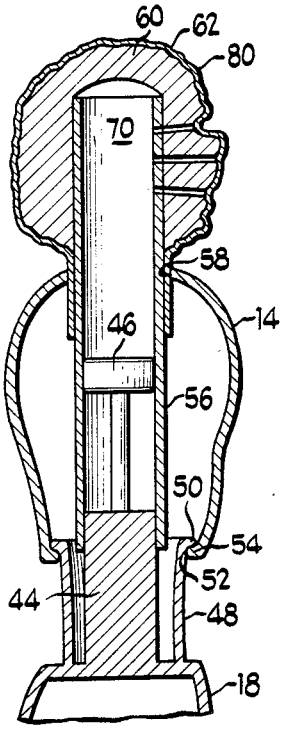
FIG. 5 is an enlarged scale, fragmentary, sectional view taken generally along line 5—5 of FIG. 2.

Extending upwardly from the approximate center of the hip portion 18, is a cylindrical post 44 atop which is carried a piston 46. Outside the post 44 and also extending upwardly from the hip portion 18 is an upwardly extending resilient skirt 48, of a generally oval configuration which flares outwardly and has upper rolled-over rim 50. The skirt 48 is sized to be received for frictionally restrained, slidable movement into and out of an opening 52 defined in the bottom of the chest portion 14, by an inwardly directed flange 54. As is shown in FIG. 5, when the legs 32 and hip portion 18 are pulled down from the upper part of the character 10, the skirt wall 48 is slightly compressed and drawn out until the rim 50 abuts the flange 54. Thus, the slight outward resilient divergence of the skirt wall 48 provides frictional resistance and the engagement of rim 50 with flange 54 prevents the hip portion and the chest portion from being completely separated.

Figure 2:
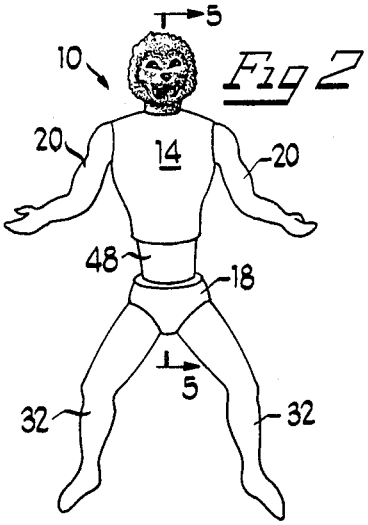
FIG. 2 is a front elevational view of the toy character extended upon operation of the pump and showing a different appearance.
Figure 3:
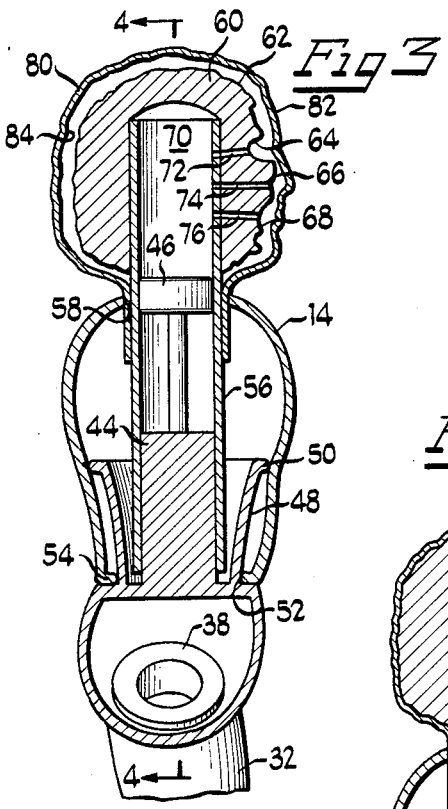
FIG. 3 is an enlarged scale, fragmentary, sectional view taken generally along line 3—3 of FIG. 1.

When the hip portion 18 and the chest portion 14 are extended to the limit permitted by the engagement of rim 50 with flange 54, as illustrated in FIGS. 2 and 5, post 44 still remains within a cylinder 56 carried by the chest portion 14 and extending above and beyond the upper neck and shoulder area of the chest portion through a neck opening 58. Supported on the open upper part of the cylinder 56 is a substantially rigid head 60 with an outer surface 62 defining a first appearance including recessed eye sockets 64, protruding nose 66, and open mouth 68. The upper part of cylinder 56 forms a hollow interior 70 for head 60. Apertures or conduits 72, 74 and 76 extend from the hollow interior 70 through the head 60 to the outer surface 62.

Around, but spaced from, the head 60 is a relatively flexible outer mask 80. Under normal atmospheric pressure on both sides, the relatively flexible mark 80 is self-supporting. The outer surface 82 has an appearance distinctively different from the appearance of the outer surface 62 of the relatively rigid inner head 60. Mask 80 may be made of a material such as virgin latex without any filler and is preferably of a uniform nominal five thousanths of an inch wall thickness, plus or minus two thousanths of an inch. Such virgin latex material in the range of three to seven thousanths thickness has been found to work well for a character, or figure in the size range of three to seven inches tall and with relatively simple pump means such as has been described in this application. The inner surface 84, of the mask 80 has a surface area generally equal to the surface area of the outer surface 62 of the more rigid inner head 60. Thus, it will be observed that the smaller inner head 60 has relatively, deeply recessed eye sockets 64, protruding nose 66, and open mouth 68 to increase the area of outer surface 62. Preferably conduits such as 72 are in regions such as eye sockets 64 of the outer surface 62 that will require greater deformation of the mask 80. Depending on the relative configurations of the outer surface 62 and the mask 80, additional conduits may have to be provided.

Mask 80 is secured about the head 60 in relatively airtight engagement by being trapped between the neck opening 58 and the adjacent portion of the cylinder 56 which effectively forms a neck. Thus, when the lower hip portion 14 is pulled down moving the piston 46 downwardly in the cylinder 56, air is withdrawn from the space between the mask 80 and the outer surface of the head reducing the atmospheric pressure until the mask is no longer self-supporting and collapses down to conform to the outer surface 62 of the head 60. When so collapsed, the mask 80 conforms to the appearance of the underlying inner head 60 and transforms the appearance from the human shown in FIG. 1 to the monster illustrated in FIG. 2.

While this invention has been shown and described with respect to a mask surrounding the entire head it will be apparent to those skilled in the art that the mask could be restricted to the front facial area of the head. Furthermore, the invention could as well be applied to other portions of the character or figure such as the chest to either transform the character from a relatively normal appearance to an extremely muscular one, or even a wounded appearance, and could even be used in the arms or legs of the character. Similarly, the reduction of pressure in the space between the underlying rigid part and the surrounding mask could be accomplished by means other than the simple piston pump shown and described in this application. For example, a leg or arm could be molded of relatively resilient material and connected by means of a tube to the space so that squeezing and releasing the arm or leg effects a change in atmospheric pressure in the space. Further changes and modifications will occur to those skilled in the art. It is intended in the appended claims to cover all such changes and modifications as fall within the true spirit and scope of the present invention.

What is claimed as new and desired to be secured by Letters Patent is:

1. A toy having a body portion comprising:

a head having a substantially rigid outer surface of a first appearance;

a relatively flexible outer mask that is self-supporting in normal atmospheric pressure with a second appearance;

the head being hollow with an interior and conduits extending from the interior through to the substantially rigid outer surface;

substantially airtight attachment of the mask to the toy, covering, but spaced from, the substantially rigid outer surface;

air at generally normal atmospheric pressure in the space between the substantially rigid outer surface and the flexible mask; and means for reducing the pressure in the space between the substantially rigid outer surface and the flexible mask to collapse the flexible mask and change the second appearance of the flexible mask to conform to the first appearance of the substantially rigid outer surface.

2. The toy of claim 1 in which the surface area of the rigid outer surface is substantially equal to the surface area of the interior of the relatively flexible outer mask.

3. The toy of claim 1 in which the thickness of the relatively flexible outer mask is generally uniform.

4. The toy of claim 1 in which the thickness of the relatively flexible outer mask is in the range of three to seven thousanths of an inch.

5. The toy of claim 1 in which:

the means for withdrawing air from the interior of the hollow head comprises a piston;

the toy figure has a torso including an upper chest portion and a lower hip portion;

the piston is in generally airtight engagement within a cylinder carried in the upper chest portion; and the lower hip portion is slidingly extendable from the upper chest portion to withdraw the piston partially from the cylinder.

6. A toy figure comprising:

a head having a substantially rigid outer surface of a first appearance;

a relative flexible outer mask that is self-supporting in normal atmospheric pressure and is spaced from the head with air in the space;

the mask having a second appearance different from the first appearance while self-supporting in normal atmospheric pressure;

a substantially airtight attachment of the outer mask about the outer surface of the head; and means for withdrawing the air from the space between the head and the outer mask so as to change the second appearance of the outer mask to an appearance conforming to the first appearance.

7. The toy figure of claim 6 in which the surface area of the rigid outer surface of the head is substantially equal to the surface area of the interior of the relatively flexible outer mask.

8. The toy figure of claim 6 in which the thickness of the relatively flexible outer mask is generally uniform.

9. The toy figure of claim 6 in which the thickness of the relatively flexible outer mask is in the range of three to seven thousanths of an inch.

10. The toy figure of claim 6 in which the head is hollow and apertures extend from inside the head through to the substantially rigid outer surface.

11. The toy figure of claim 10 in which:

the means for withdrawing air from the interior of the hollow head comprises a piston;

the toy figure has a torso including an upper chest portion and a lower hip portion;

the piston is attached to the lower hip portion;

the piston is in generally airtight engagement within a cylinder carried in the upper chest portion; and the hip portion is slidingly extendable from the upper chest portion to withdraw the piston partially from the cylinder.

12. A toy figure comprising:

a neck supporting a hollow head having an interior and a substantially rigid outer surface of a first appearance;

a relatively flexible, self-supporting in normal atmospheric pressure, outer mask having a second appearance;

means for securing the mask substantially airtight about the neck but otherwise spaced from the hollow head;

air in the hollow head and in the space between the head and the mask;

apertures extending from the interior of the hollow head through to the substantially rigid outer surface; and means for withdrawing the air from the interior of the hollow head so as to change the second appearance of the outer head mask to an appearance conforming to the first appearance.

13. The toy figure of claim 12 in which the surface area of the rigid outer surface of the head is substantially equal to the surface area of the interior of the relatively flexible outer head mask.

14. The toy figure of claim 12 in which the thickness of the relatively flexible outer head mask is generally uniform.

15. The toy figure of claim 12 in which the thickness of the relatively flexible outer mask is in the range of three to seven thousanths of an inch.

16. The toy figure of claim 12 in which:

the means for withdrawing air from the interior of the hollow head comprises a piston;

the toy figure has a torso including an upper chest portion and a lower hip portion;

the piston is attached to the lower hip portion;

the piston is in generally airtight engagement within a cylinder carried in the upper chest portion; and the lower waist is slidingly extendable from the upper chest portion to withdraw the piston partially from the cylinder.

* * * * *